US011179596B2

(12) United States Patent
Karys

(10) Patent No.: US 11,179,596 B2
(45) Date of Patent: Nov. 23, 2021

(54) RESISTANCE EXERCISE APPARATUS AND ACCOMPANYING METHOD

(71) Applicant: Peter Karys, Newton, MA (US)

(72) Inventor: Peter Karys, Newton, MA (US)

( * ) Notice: Subject to any disclaimer, the term of this patent is extended or adjusted under 35 U.S.C. 154(b) by 1 day.

(21) Appl. No.: 16/572,279

(22) Filed: Sep. 16, 2019

(65) Prior Publication Data

US 2020/0086163 A1 Mar. 19, 2020

Related U.S. Application Data

(60) Provisional application No. 62/731,464, filed on Sep. 14, 2018.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/005*** | (2006.01) |
| ***A63B 24/00*** | (2006.01) |
| ***A63B 22/02*** | (2006.01) |

(52) U.S. Cl.

CPC ..... *A63B 21/4009* (2015.10); *A63B 21/0058* (2013.01); *A63B 21/0442* (2013.01); *A63B 21/0557* (2013.01); *A63B 22/02* (2013.01); *A63B 24/0087* (2013.01); *A63B 2225/20* (2013.01); *A63B 2225/50* (2013.01)

(58) Field of Classification Search

CPC ..... A63B 21/005; A63B 21/0058; A63B 21/0059; A63B 21/04; A63B 21/0442; A63B 21/0552; A63B 21/0555; A63B 21/0557; A63B 21/4009; A63B 22/02; A63B 22/0285; A63B 22/0207; A63B 22/0235; A63B 22/0242; A63B 22/025; A63B 22/0257; A63B 22/0264; A63B 22/0271; A63B 22/0278; A63B 22/0292; F16B 5/02; F16B 5/0208; F16B 5/0216; F16B 5/0225; F16B 5/0275; F16B 13/00

See application file for complete search history.

(56) References Cited

U.S. PATENT DOCUMENTS 4,998,725 A * 3/1991 Watterson ..... A63B 21/015 345/38
6,123,649 A * 9/2000 Lee ..... A63B 21/153 482/51

(Continued)

*Primary Examiner* — Garrett K Atkinson
*Assistant Examiner* — Zachary T Moore
(74) *Attorney, Agent, or Firm* — Bay State IP, LLC

(57) ABSTRACT

An adjustable resistance apparatus including a universal mounting bracket assembly, the universal mounting bracket assembly secures the adjustable resistance apparatus to a treadmill, an electric winch, an upper cross-member, wherein the upper cross-member provides structural support to the adjustable resistance apparatus, a lower cross-member, wherein the lower cross-member holds the electric winch, an elastomeric band, wherein the elastomeric band is secured on one end to the electric winch and on an opposite end to a waist attachment point; and a control box, wherein the control box further includes a frame, a microcontroller and receiver/transmitter couple utilizing a personal area network (WPAN) or even a wireless personal area network (WPAN) such as a IrDA, Wireless USB, Bluetooth® and ZigBee® receiver and transmitter, a 12-volt power supply; and a winch relay.

10 Claims, 21 Drawing Sheets

(56) References Cited

U.S. PATENT DOCUMENTS

| | | | | |
|---|---|---|---|---|
| 6,454,679 | B1 * | 9/2002 | Radow | A63B 22/0235 482/4 |
| 9,633,573 | B1 * | 4/2017 | Tafoya | A63B 69/00 |
| 2014/0038777 | A1 * | 2/2014 | Bird | G16Z 99/00 482/5 |
| 2015/0011368 | A1 * | 1/2015 | Manor | A63B 21/4043 482/116 |
| 2015/0367171 | A1 * | 12/2015 | Truong | A61H 11/02 482/4 |
| 2017/0266483 | A1 * | 9/2017 | Dalebout | A63B 71/0036 |
| 2017/0312582 | A1 * | 11/2017 | Root, Jr. | A63B 21/4009 |
| 2018/0264306 | A1 * | 9/2018 | Agrawal | A61F 5/02 |
| 2019/0209891 | A1 * | 7/2019 | Fung | A63B 22/0664 |
| 2021/0001171 | A1 * | 1/2021 | Fung | G06F 3/016 |

* cited by examiner

RESISTANCE EXERCISE APPARATUS AND ACCOMPANYING METHOD

CROSS REFERENCE TO RELATED APPLICATION

This application takes priority from and claims the benefit of U.S. Provisional Patent Application Ser. No. 62/731,464 filed on Sep. 14, 2018, the contents of which are herein incorporated by reference.

BACKGROUND OF THE INVENTION

Field of the Invention

The present system, method and accompanying apparatuses pertain generally to exercise systems and apparatuses, and more particularly to a variable resistance creation system for use in aerobic activities.

Description of the Art

Exercise equipment includes a multitude of devices for use with arm and leg members for the purpose of stimulating and developing muscle tone, strength and agility as well as for reducing weight and fat tissue.

It is recognized that walking is a natural form of exercise and that the use of a treadmill apparatus enables the user to obtain the benefit of walking, jogging, and running exercises while on a stationary platform unit. The speed and slope of the walking surface can be adjusted to the needs and fitness level of the participant. While the treadmill has many advantages, fitness enthusiasts, physical therapists, trainers and others often need to utilize muscle exercises concurrently with the type of exercise provided by a treadmill.

One new form of exercise that attempts to address this need are parachute training devices. In this type of exercise, the user typically attaches a small parachute to his or her torso. The user begins a running motion, which opens the parachute and creates resistance to forward movement. Although this rearward resistance is effective for speed training, the use of a parachute device requires a relatively large open area, as these devices are neither adapted nor suitable for indoor training. Additionally, although such devices are extremely effective in speed training and muscle conditioning, the cords associated with the parachute can often become tangled with the legs of the user, leading to injury.

Furthermore, if sufficient speed is not applied to the parachute, it will not open properly so as to create the necessary resistance force. This prevents the user from utilizing a parachute to apply a constant resistance who is only able to walk or jog slowly.

Treadmill resistance apparatuses provide a means of controlling exercise resistance force to the leg, thigh, calf, and trunk muscles as well as certain other body muscle groups such as the arms. The resistance force is applied to each leg or arm in an independent manner. More specifically, the major leg muscles involved are the quadriceps, the upper thigh, anterior and posterior hamstrings, buttocks and lower back. The major arm muscles involved are the deltoids, triceps, biceps, brachialis, flexors and the other interacting arm muscle groups. Additionally, muscle groups in the body which interact with the leg and arm muscles and other major muscle groups of the body can be exercised.

Another benefit of the treadmill resistance apparatus is that the force resistance is provided from the back of the body rather than from the front of the body. Rear loading mimics the common position of usual resistance forces. Furthermore, the resistance allows for positive loading to the body during exercise wherein the tension being applied is constant.

There exist several resistance apparatuses capable of varying the resistance applied to the user, however, they lack the capability to allow the user to vary resistance remotely during use. An advance in the art may therefore encompass a resistance apparatus, designed for specific use with a treadmill, with variable resistance, which can be remotely adjusted during use or pre-programmed to apply a variety of resistances throughout a workout. The ability to pre-program and adjust resistance during a workout is particularly helpful to trainers and physical therapists who must fine tune a workout to an individual's needs, which may change throughout the workout.

SUMMARY OF THE INVENTION

The instant system, method and accompanying series of apparatuses, as illustrated herein, are clearly not anticipated, rendered obvious, or even present in any of the prior art mechanisms, either alone or in any combination thereof. A versatile system, method and series of apparatuses for creating and utilizing an exercise system and several embodiments of the instant apparatus are illustrated herein.

A primary object of the instant resistance apparatus is to provide a resistance exercise system capable of remote adjustment such that the user can adjust the resistance of the band while using the system, i.e. running on a treadmill with the resistance band attached.

Another object of the resistance apparatus is to provide a resistance exercise system capable of applying predetermined resistance sequences while the user is running on a treadmill.

In one embodiment, a resistance apparatus is disclosed, wherein the resistance apparatus includes: a universal mounting bracket capable of fitting to any traditional treadmill; upper and lower cross-members, which support the winch and allow its position to be adjusted up and down; an electric winch; an elastomeric band secured to the winch; and a control system including a transmitter/receiver pair.

Addressing usage of the control system including a receiver and transmitter pair, a personal area network (PAN) is a computer network for interconnecting devices centered on an individual person's workspace. A PAN provides data transmission amongst devices such as computers, smartphones, tablets and personal digital assistants. PANs can be used for communication amongst the personal devices themselves, or for connecting to a higher level network and the Internet (an uplink) where one master device takes up the role as gateway. A PAN may be carried over wired computer buses such as USB.

One embodiment, particularly suited for home and small environment usage may include a wireless personal area network (WPAN) is a low-powered PAN carried over a short-distance wireless network technology such as IrDA, Wireless USB, Bluetooth® and ZigBee®. This is particularly true as the reach of a WPAN normally varies from a few centimeters to a few meters.

In one embodiment of a WPAN arrangement, the control system may utilize a Bluetooth® transmitter/receiver. Bluetooth® is a wireless technology standard for exchanging data over short distances (using short-wavelength UHF radio waves in the ISM band from 2.400 to 2.485 GHz) from fixed and mobile devices, and building personal area networks (PANs).

In an additional embodiment, the resistance apparatus may include a remote-controlled device, in which a user can program pre-determined resistance profiles through a mobile device app. The user may predetermine the number of turns that the winch will wind and unwind throughout the workout. For example, a user could set the program to have a resistance setting of 1 for the first five minutes, after which the resistance level will automatically adjust to 3 for the next five minutes, then to 6 for the next 5 minutes, and finally back to 1 for the last five minutes of cool down.

BRIEF DESCRIPTION OF THE DRAWINGS

Advantages of the present apparatus will be apparent from the following detailed description of exemplary embodiments thereof, which description should be considered in conjunction with the accompanying drawings, in which, having thus described the system in general terms, reference will now be made to the accompanying drawings, which are not necessarily drawn to scale, and wherein.

DETAILED DESCRIPTION OF THE SEVERAL EMBODIMENTS

Figure 1:
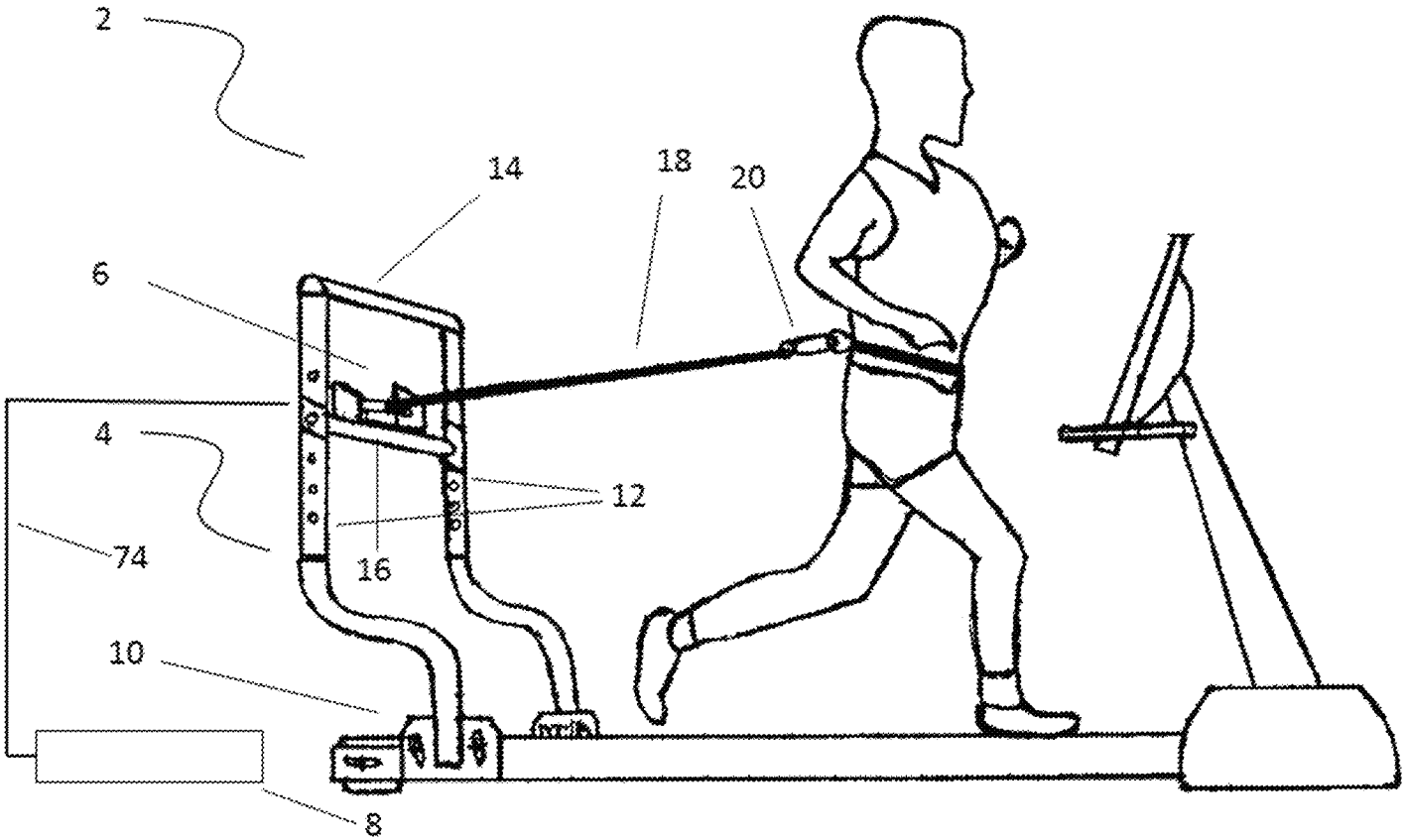
FIG. 1 illustrates a side view of an embodiment of an adjustable resistance apparatus.

The detailed description set forth below in connection with the appended drawings is intended as a description of presently-preferred embodiments of the apparatus and does not represent the only forms in which the present apparatus may be constructed and/or utilized. The description sets forth the functions and the sequence of steps for constructing and operating the apparatus in connection with the illustrated embodiments. However, it is to be understood that the same or equivalent functions and sequences may be accomplished by different embodiments that are also intended to be encompassed within the spirit and scope of the invention.

For the following defined terms, these definitions shall be applied, unless a different definition is given in the claims or elsewhere in this specification. All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

FIG. 1 illustrates a side view of one embodiment of an adjustable resistance apparatus 2, wherein the adjustable resistance apparatus 2 comprises a frame 4, an electric winch 6, a control box 8 and a control cable 74 (shown further illustrated in FIG. 7 below). The frame may further comprise a universal mounting bracket assembly 10, a set of vertical poles 12, an upper cross-member 14 and a lower cross-member 16.

In an additional embodiment, the electric winch adjustably increases or decreases the tension on an elastomeric resistance band 18, which may attaches to the user's waist, or numerous other areas, at an attachment point 20.

Figure 2A:
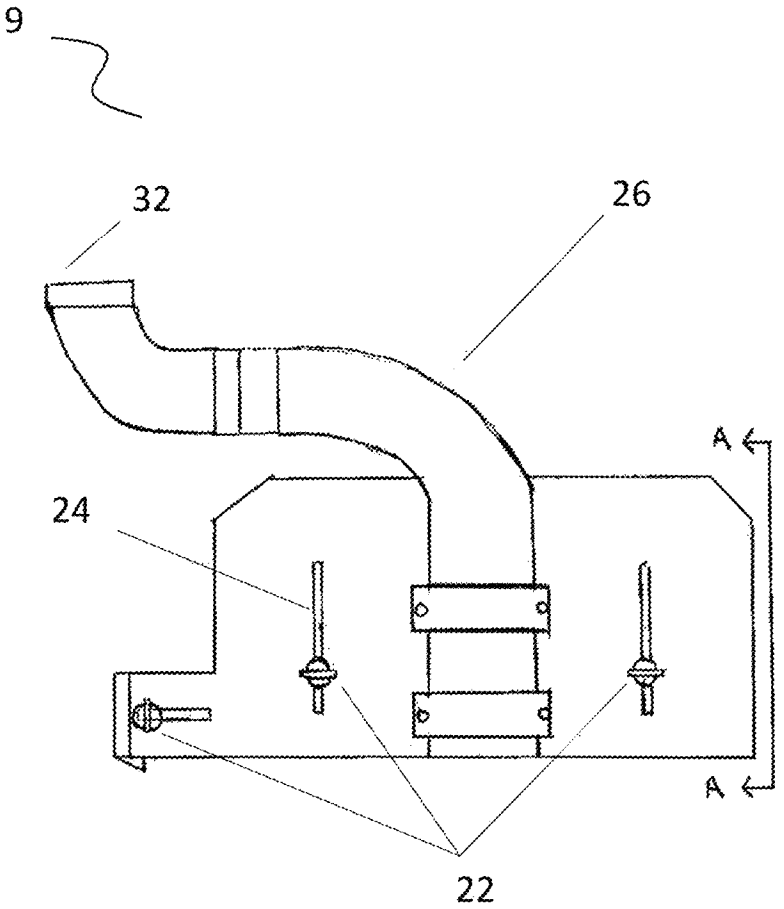
FIG. 2A illustrates a side view of an embodiment of a side portion of the mounting bracket assembly.
Figure 2B:
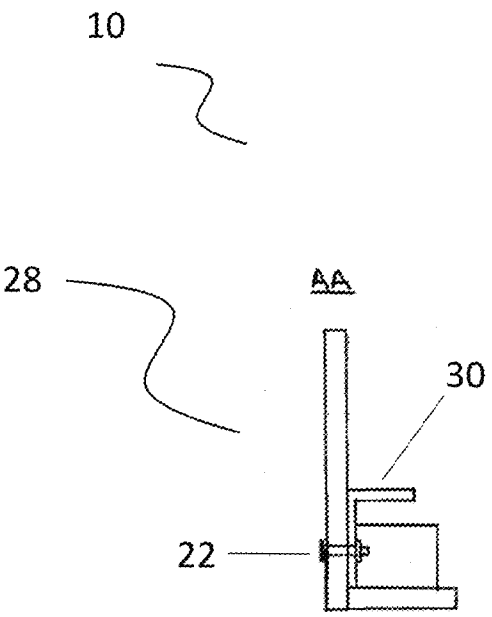
FIG. 2B illustrates a side view of a rear portion of a mounting bracket assembly.

FIG. 2A illustrate a side view of an embodiment of the side portion 9 of the mounting bracket assembly 10, which attaches to the side rails of a treadmill by means of a set of winged bolts 22. The mounting brackets 10 are adjustable by sliding the winged bolts 22 to the appropriate position in a winged bolt slot 24 and then tightening the winged bolts 22 to a treadmill frame. The mounting brackets 10 further comprise a 16-gauge steel material. FIG. 2B illustrates a side view of a rear portion 28 of the mounting bracket 10, which prevents the side portion 9 from sliding along the side rail of the treadmill while a user exerts force upon the elastomeric band 18, which is attached to the adjustable resistance apparatus 2 by means of an electric winch 6 (shown in FIG. 1). The rear portion 28 further comprises an adjustable clamp 30 locking mechanism, which is tightened by one or more winged bolts 22, and may be attached to a variety of treadmill types.

In another embodiment, the mounting bracket further comprises a downtube 26, the top 32 of which attaches to the set of vertical poles 12 and anchors the vertical poles 12 to the treadmill (Shown in FIG. 1). The downtube 26 further comprises a curved pipe, the shape of which allows for maximum contact between the side portion 9 of the bracket and the side of a treadmill, which increases the stability of the overall system, while still positioning the vertical poles 12, winch 6, and elastomeric band 18, as far toward the back of the treadmill as possible. Positioning of the adjustable resistance apparatus toward the far rear of the treadmill provides the user with plenty of space to move on the treadmill, particularly for users with long gaits. The top 32 of the downtube 26 further comprises a threaded inner radius, into which the vertical poles 12 can be removably threaded for quick and simple assembly and disassembly.

Figure 3:
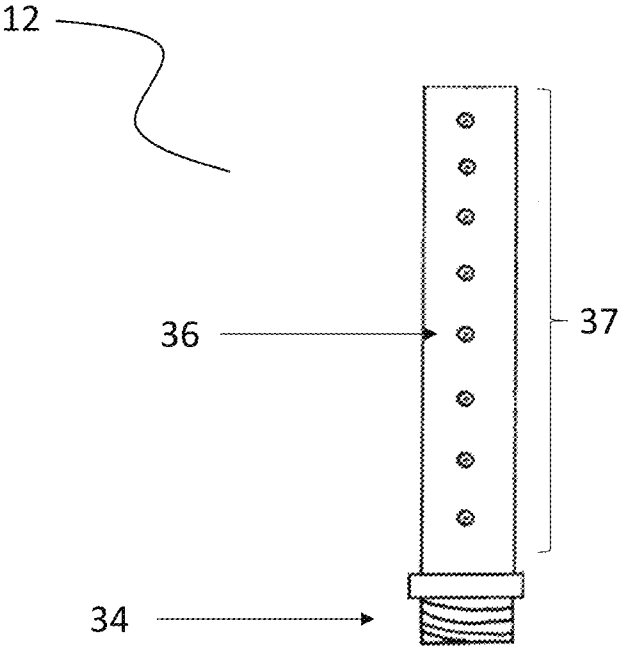
FIG. 3 illustrates a side view of a single vertical pole.

FIG. 3 illustrates a side view of a single vertical pole 12, which attaches to the top 32 of the downtube 26 by means of a threading mechanism. The bottom of the vertical pole 12 comprises a thread 34, which mates with the thread on the inner radius of the top 32 of the downtube 26. The vertical pole 12 further comprises a series of holes 36 along its length, which mate with locking hitch pins 56 (shown in FIG. 5) to hold the lower cross-member 16 (shown in FIG. 1). The locking hitch pins 56 are easily attached and removed and enable the lower cross-member 16 to slide up and down the vertical poles 12 when detached. The lower cross-member 16 can be reattached by inserting the locking hitch pins 56 into any of the holes 36.

Figure 4:
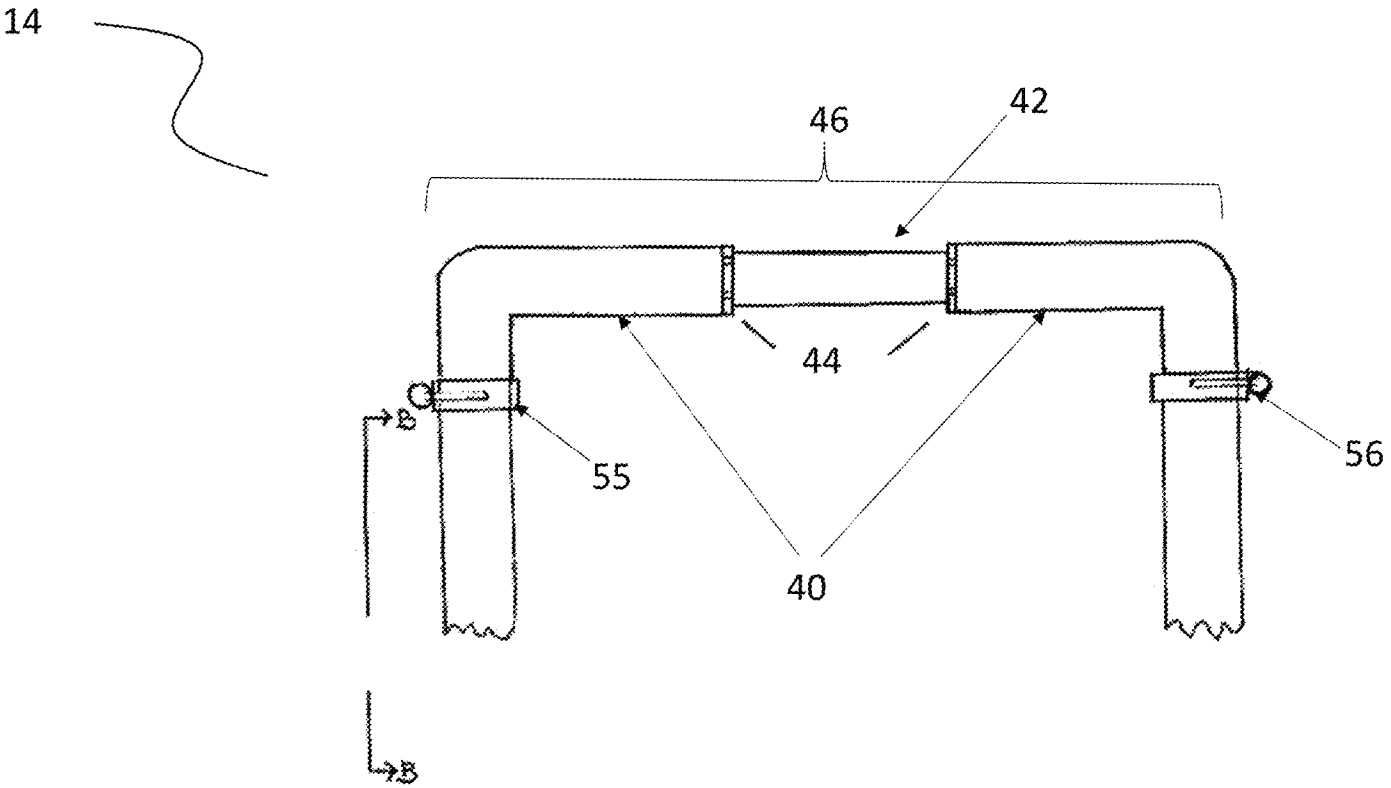
FIG. 4 illustrates a front view of the upper cross-member.

FIG. 4 illustrates a front view of the upper cross-member 14, which provides structural support to the adjustable resistance apparatus 2 and is adjustable in length to fit the width of a variety of treadmills. The upper cross-member 14 further comprises a first set of two exterior pipes 40 and a first center pipe 42 with smaller diameter than the first set of exterior pipes 40. The first center pipe 42 fits into each of the second exterior pipes 40 and is adjustably fixed by a first pair of compression nuts 44. When the first compression nuts 44 are loosened, the first exterior pipes 40 may be pulled apart, exposing more of the first center pipe 42, so as to increase the length 46 of the upper cross-member 14. Likewise, the first exterior pipes may be pushed closer together, shrinking the length of exposed first center pipe 42 and the length 46 of the upper cross-member 14. Each of the exterior pipes 40 further comprise collars 55 on each end that fit over the tops of vertical poles 12 and lock into place using locking hitch pins 56.

Figure 5:
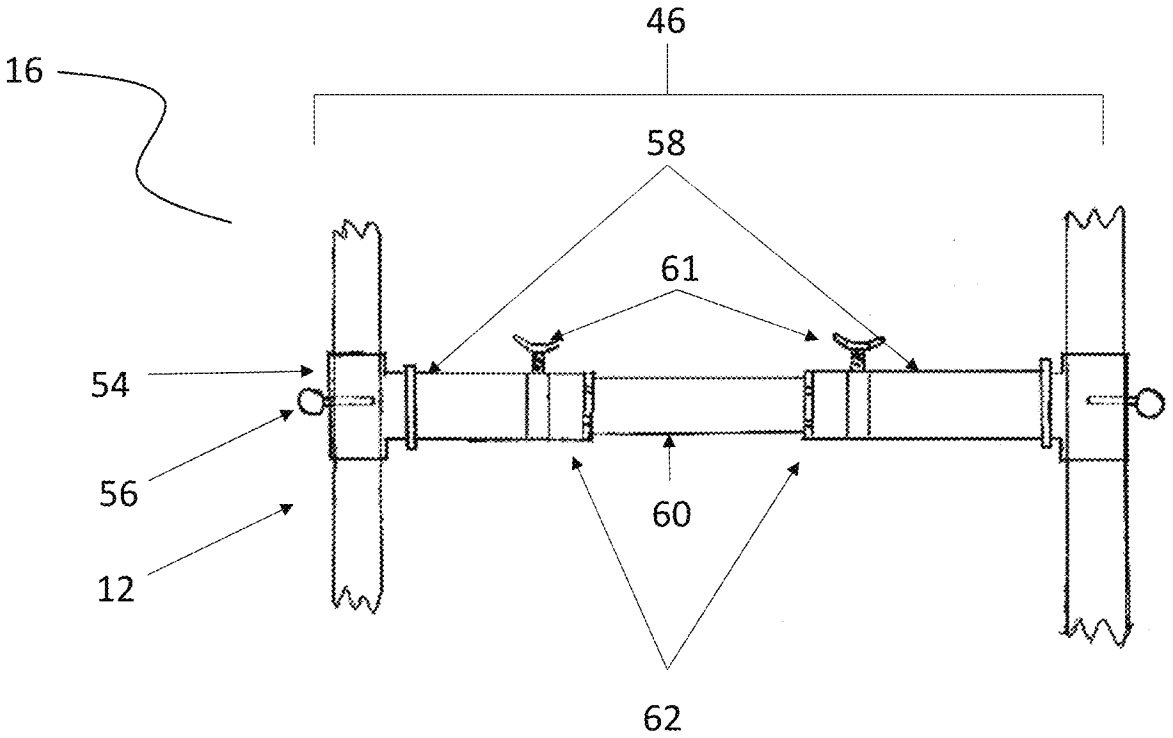
FIG. 5 illustrates a front view of the lower cross-member.

FIG. 5 illustrates a front view of the lower cross-member 16, which holds the electric winch 6 in place. The lower cross-member further comprises two hollow receiver ends 54 oriented perpendicularly to the portion of the lower cross member 16 that holds the electric winch 6 in place. The receiver ends 54 fit over the vertical poles 12 and may slide up and down the vertical poles 12 to adjust the height of the winch 6. The lower cross-member 16 is held in place by a set of locking hitch pins 56 wherein the lower cross-member may be adjusted to a variety of heights and locked in place by inserting the locking hitch pins 56 through the receiver ends 54 and into the holes 36 of the vertical poles 12.

The lower cross-member 16 further comprises a second set of exterior pipes 58 and a second center pipe 60 with smaller diameter than the second exterior pipes 58. The second center pipe 60 fits into each of the second exterior pipes 58 and is adjustably fixed by a second pair of compression nuts 62. When the second compression nuts 62 are loosened, the second exterior pipes 58 may be pulled apart, exposing more of the second center pipe 60, so as to increase the length 46 of the lower cross-member 16. Likewise, the second exterior pipes 58 may be pushed closer together, shrinking the length of exposed center pipe 60 and the length 46 of the lower cross-member 14. A set of winch bolts 61 secure the winch 6 to the lower cross-member 16.

Figure 6B:
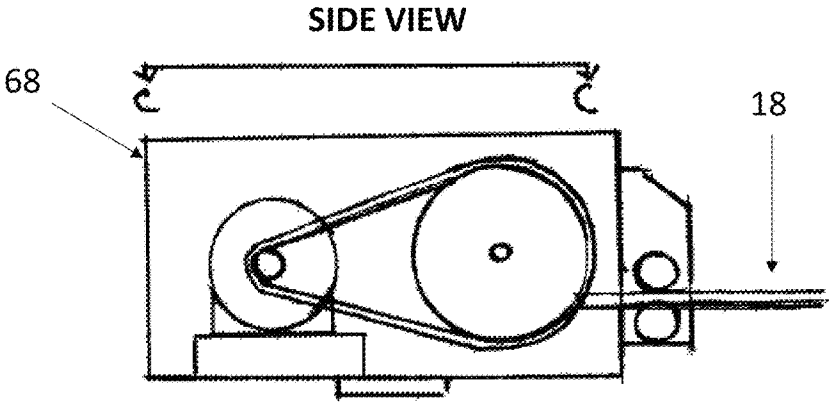
FIG. 6B illustrates a side view of the winch.
Figure 6A:
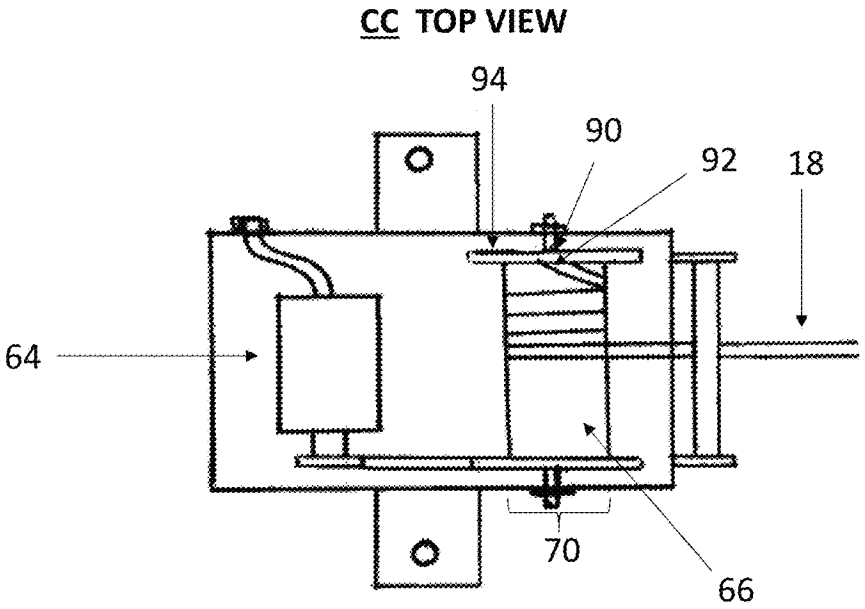
FIG. 6A illustrates a top view of the winch.

FIG. 6A illustrates a top view of the winch 6, which in one embodiment comprises a 12-volt DC heavy duty gear motor 64 and a 1.5-inch diameter drum 70 winch 66, which are housed in a frame 68 and attached to the lower cross member 16 (Shown in FIG. 1). The elastomeric band 18 attaches to the 1.5-inch diameter drum 70 winch 66 on one end and to the user's waist on the other end (shown in FIG. 1). The elastomeric band 18 may further comprise a variety of elastic compositions and tensions varying from 10 pounds to 50 pounds. The bands 18 are easily interchangeable. The user must only tie a knot 90 at the end of a desired band 18 before dropping the knot 90 into a slot 92 on an outside edge 94 of the drum 70. Different ranges of band 18 resistance can be achieved with different band 18 types. In addition to increasing/decreasing resistance by winding the winch 6, the user may select a tauter band 18 such that less winding of the winch 6 provides more resistance. In another embodiment, the winch 6 uses an 84-rpm motor with a torque stall of 84 pounds per square inch. The winch 6 has a chain drive with a 3:1 gear ratio 72, which provides a maximum nominal torque of 189 pounds. The maximum force capable of being exerted on the user in the present embodiment is approximately 30 pounds.

Figure 7:
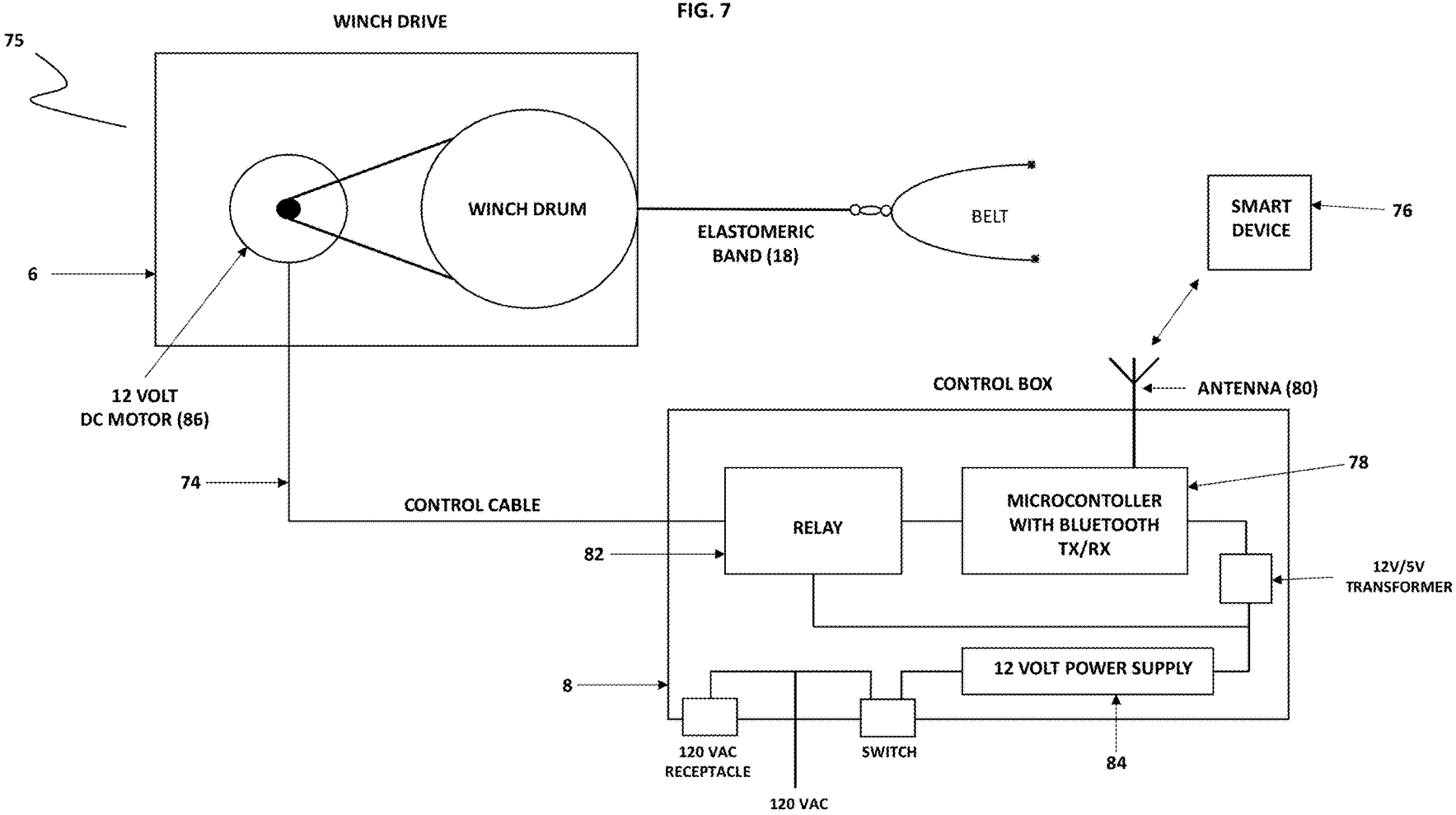
FIG. 7 illustrates a block diagram of the overall system.

FIG. 7 illustrates a block diagram of the overall system 75, control box 8, which connects to the winch 6 via a control cable 74. The winch motor 86 is controlled by Bluetooth® via a smart device 76 application. In another embodiment, the control box 8 further comprises a microcontroller 78 with a Bluetooth® receiver and transmitter 80, a 12-volt power supply 84 and winch relay 82. In another embodiment, the microcontroller receives data from the smart device 76 to activate the winch motor 86.

The microcontroller 78 supplies the appropriate voltage and polarity to the relay 82, which activates the winch motor 86. The microcontroller 78 tracks the number of revolutions of the drum winch 70 and, through an algorithmic process, a microprocessor 88 converts the number of revolutions to a relative force value exerted on the user. The relative force value will be within a range of 1-10 and will be transmitted through Bluetooth® to the smart device 76 application and display on the smart device 76.

The user may remotely adjust the resistance of the band 18 either during use, by means of an application on the user's phone or other mobile device. The user can also program pre-determined workout routines, in which the winch 8 automatically winds at desired times. For instance, the user can set up a program to have a resistance level of 1 for the first five minutes of the user's warm up. After 5 minutes, the resistance level will increase to 3, then to 6 for the next 5 minutes, then back down to 3 for the next five minutes, and finally back to level 1 for the last 5 minutes of cooldown.

Figure 8:
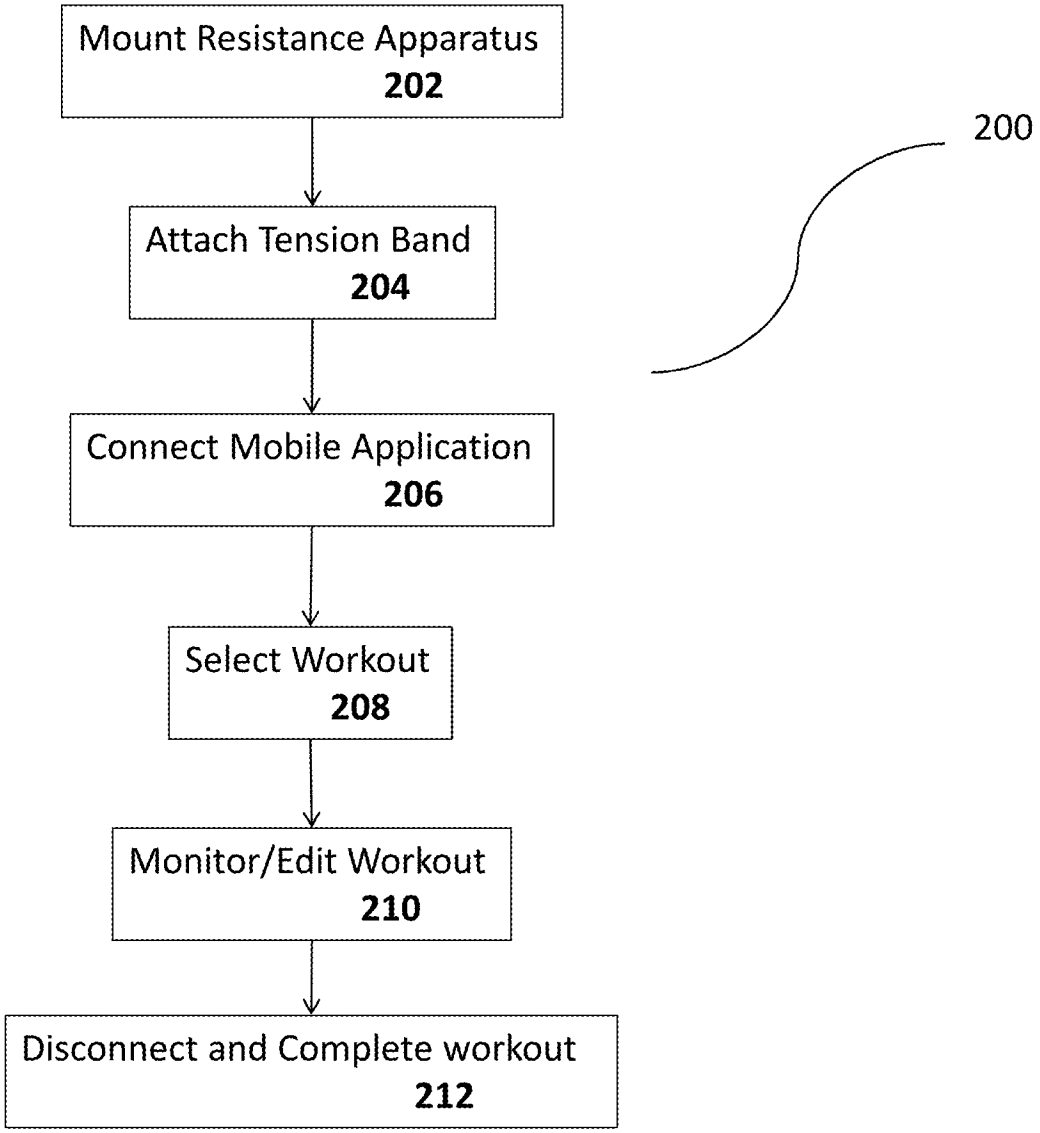
FIG. 8 illustrates a flow diagram instructing a user regarding donning, preparation, calibration and operation of the present system.

FIG. 8 illustrates a flow diagram 200 instructing a user regarding donning, preparation, calibration and operation of the present system. At step 202 the resistance apparatus attaches to a treadmill by adjusting winged bolts on the lower mounting bracket assembly (shown in FIG. 2A). Then cross members 14 and 16 connecting both arms of the apparatus adjust by sliding the central bar through exterior pipes until reaching the appropriate width for the treadmill.

In one embodiment, the lower cross member 16 may be leveled with the user's waist by adjusting a set of locking hitch pins 56 through the vertical poles 12. After mounting the apparatus and adjusting for a secure fit, at step 204 the user may select a tension band of with the desired resistance. As previously described, the apparatus accommodates a range of resistance bands which are easily mounted and dismounted for tension change as necessary. The band is tied to the rotating drum of the winch and threaded through the motor towards the front of the treadmill. At step 206 the user opens the mobile application on their phone or associated electronic device. The mobile application connects to the microcontroller through the Bluetooth capabilities of the smart device. A user can control the device connection to the apparatus within the app (shown in FIG. 9). At step 208 the user selects a workout within the app including the resistance level, interval, and length of time for the session. The app then directs the apparatus to calculate the relative force based on the resistance selected and turn the winch until this force is reached. The application gives the user feedback on the force being applied and displays it on the smart device.

At step 210 the user can monitor the workout in real time through the mobile application. The user may change workout parameters manually at any point during the workout using controls in the mobile application. If the user does not make any adjustments, the application directs the apparatus to continue the original protocol. After completing a workout, at step 212, the Bluetooth® connection control in the app manually disconnects the mobile application from the apparatus.

Figure 9:
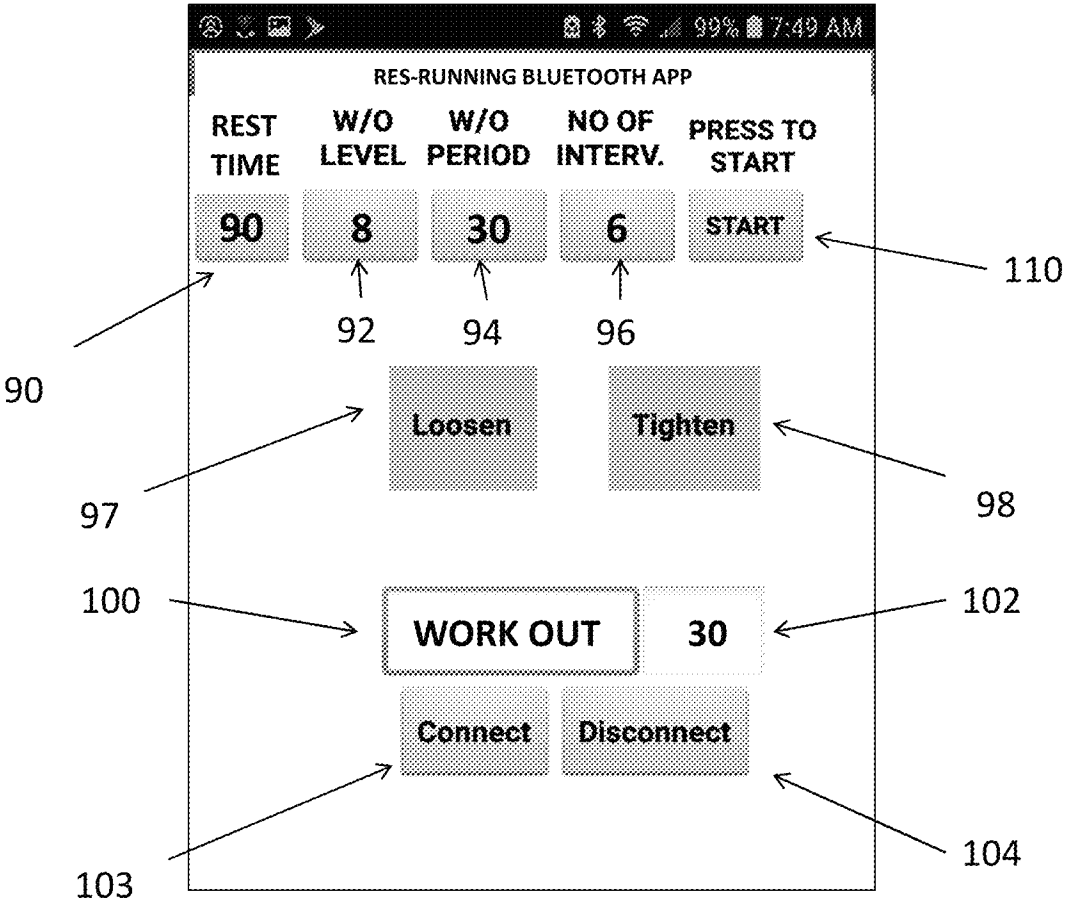
FIG. 9 illustrates an associated mobile application for controlling the resistance apparatus.
Figure 10:
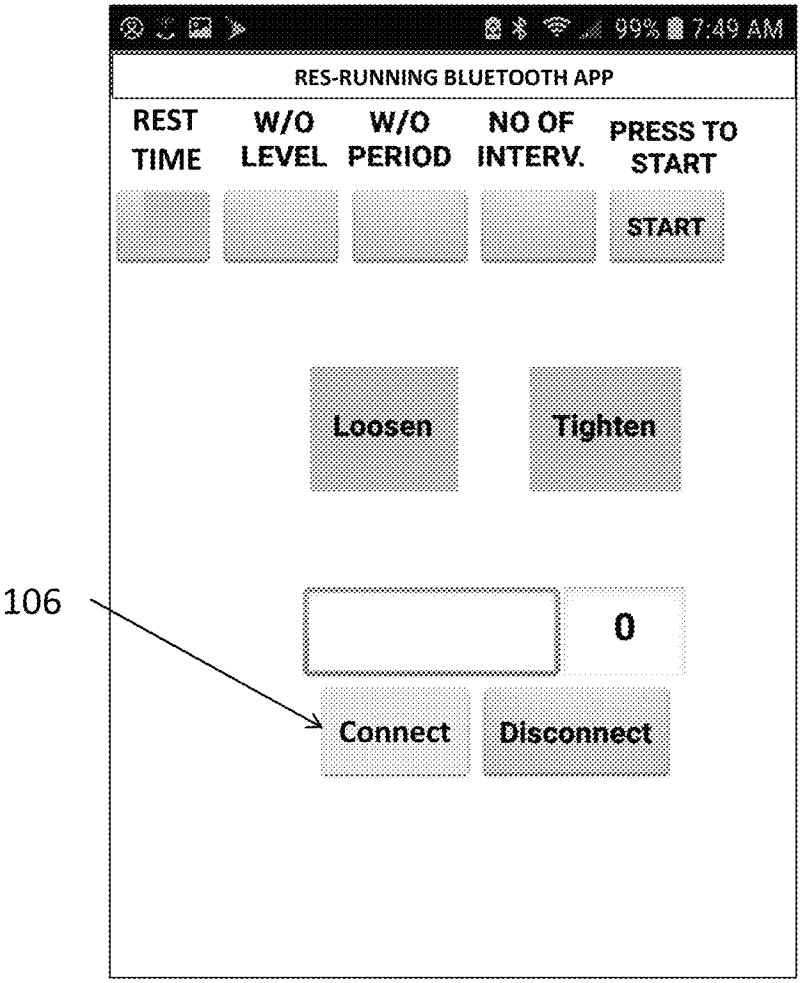
FIGS. 10-21 illustrate the stepwise method for setting parameters and initiating a workout.

FIG. 9 illustrates an associated mobile application for controlling the resistance apparatus. The mobile application may possess a start button 110 to initiate a sequence and associated inputs to adjust all the relevant workout parameters. The user may set the rest time 90, the resistance level for the workout 92, the length of the workout 94, and the number of intervals 96 for pre-programmed resistance workouts. Manual adjustments of elastomeric resistance band 18 may be made via a tighten button 97 and loosen button 98.

The workout status 100 is also displayed in order for the user to determine whether the workout is active, or paused. Additionally, a time display 102, adjacent to the workout status 100 indicator, monitors the elapsed time of the workout. Thus, a user can pause and resume their workout by selecting the status indicator.

Moreover, a Bluetooth® connection control system may provide a connect button 103 and a disconnect button 104, displayed along the bottom of the screen allows a user to connect the mobile application to the microcontroller of the resistance apparatus. FIGS. 10-21 illustrate the stepwise method for setting parameters and initiating a workout. Initially, a user connects the mobile application to the device by selecting the Bluetooth® connection control input 106.

Figure 11:
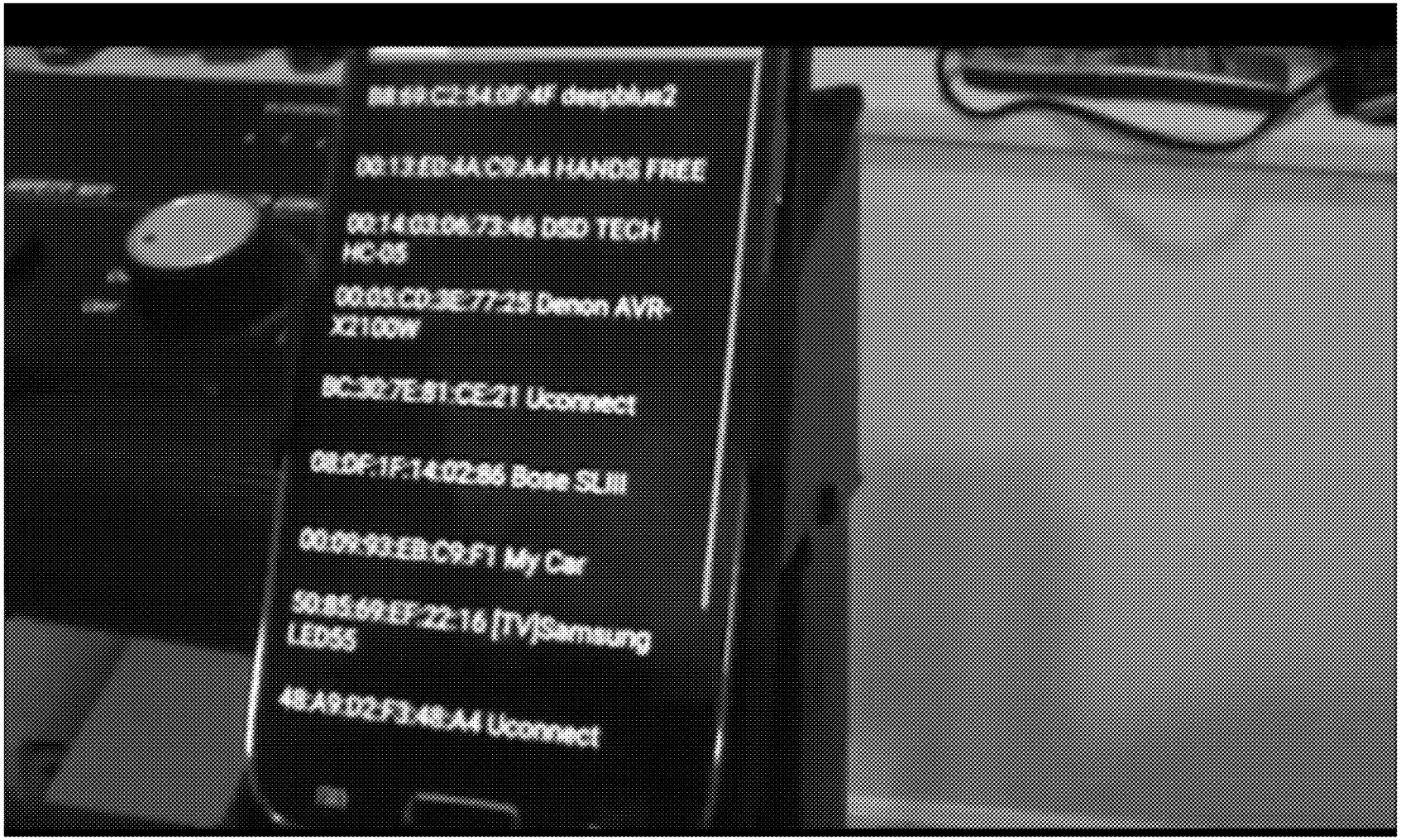
Figure 12:
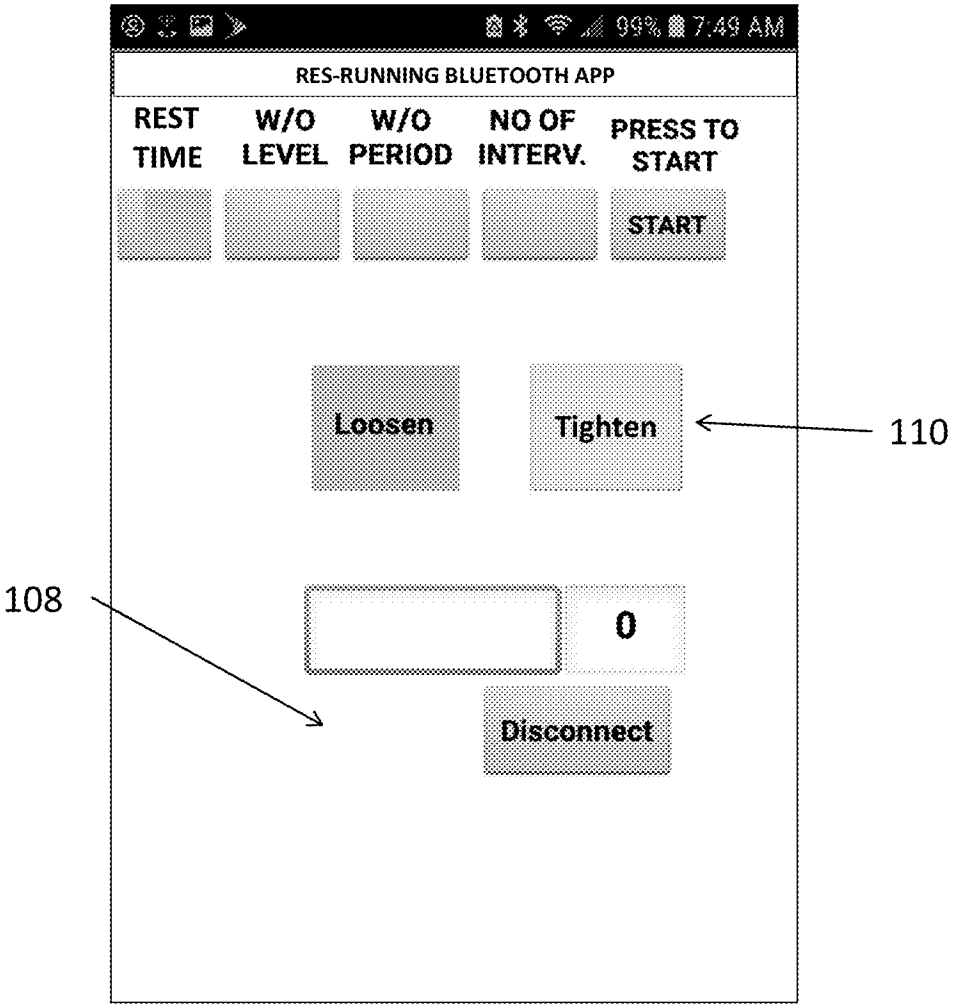
Figure 13:
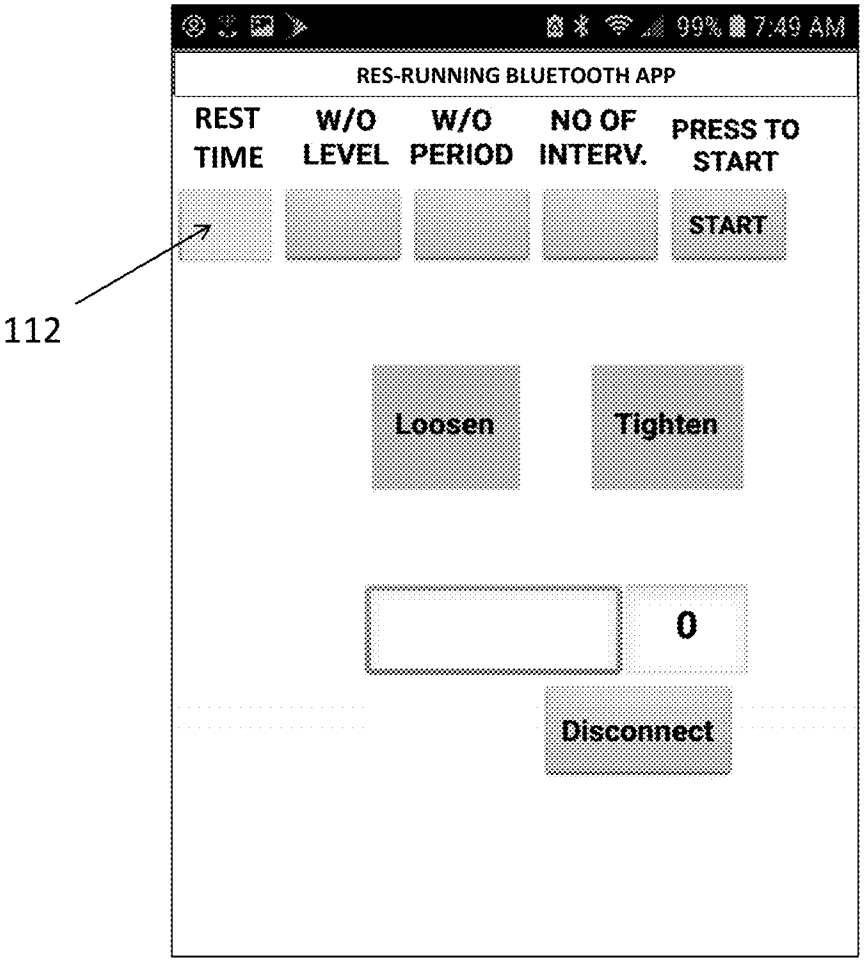
Figure 14:
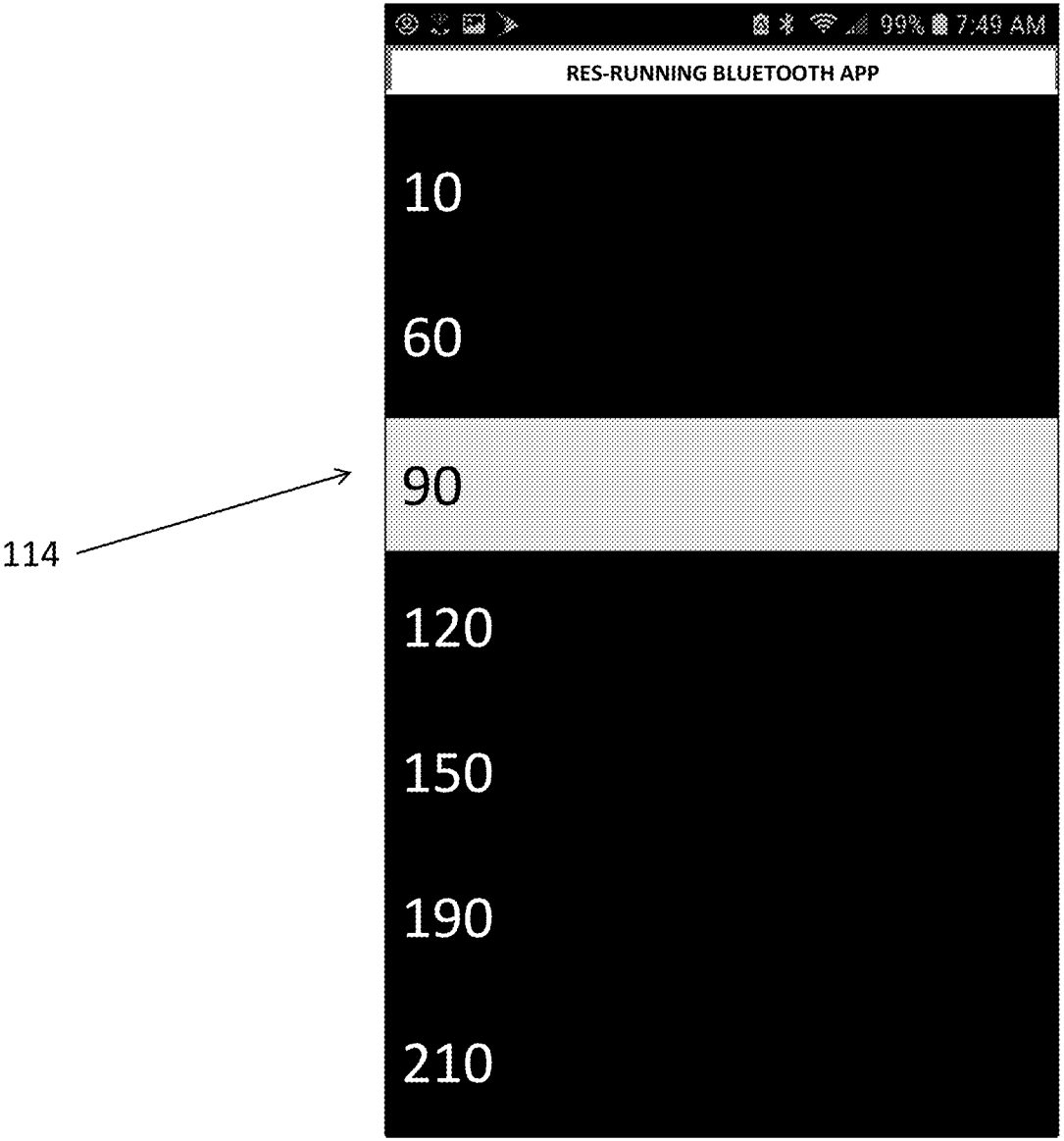
Figure 15:
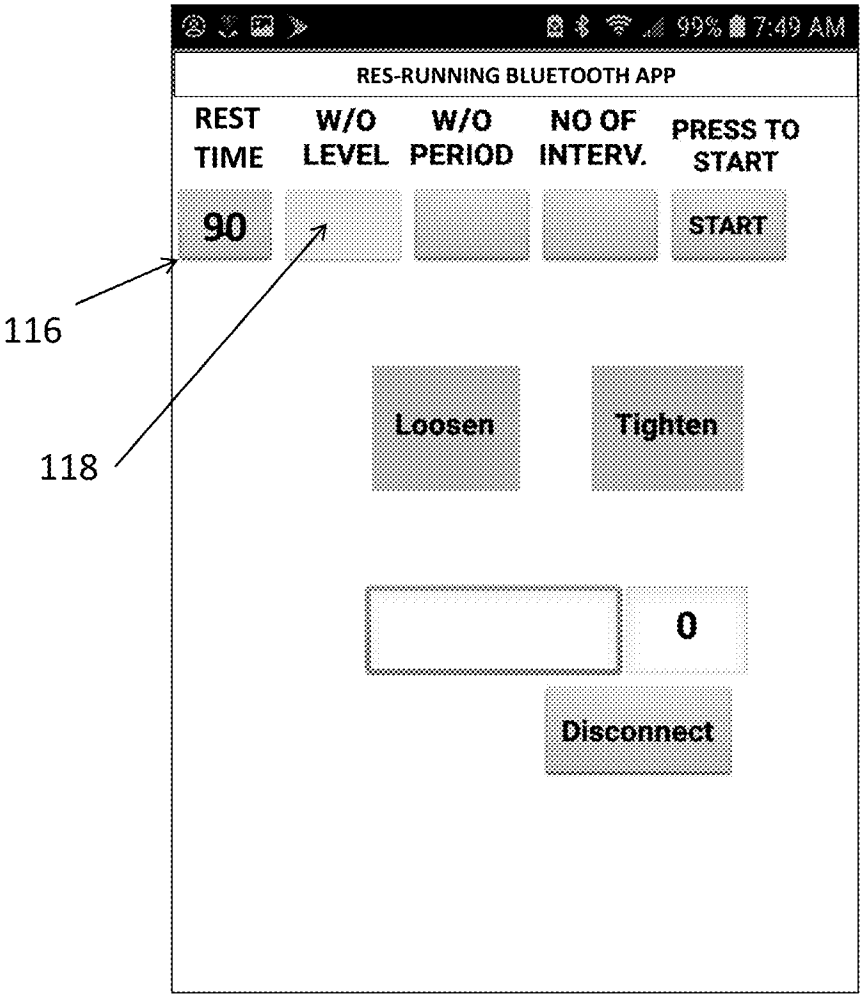
Figure 16:
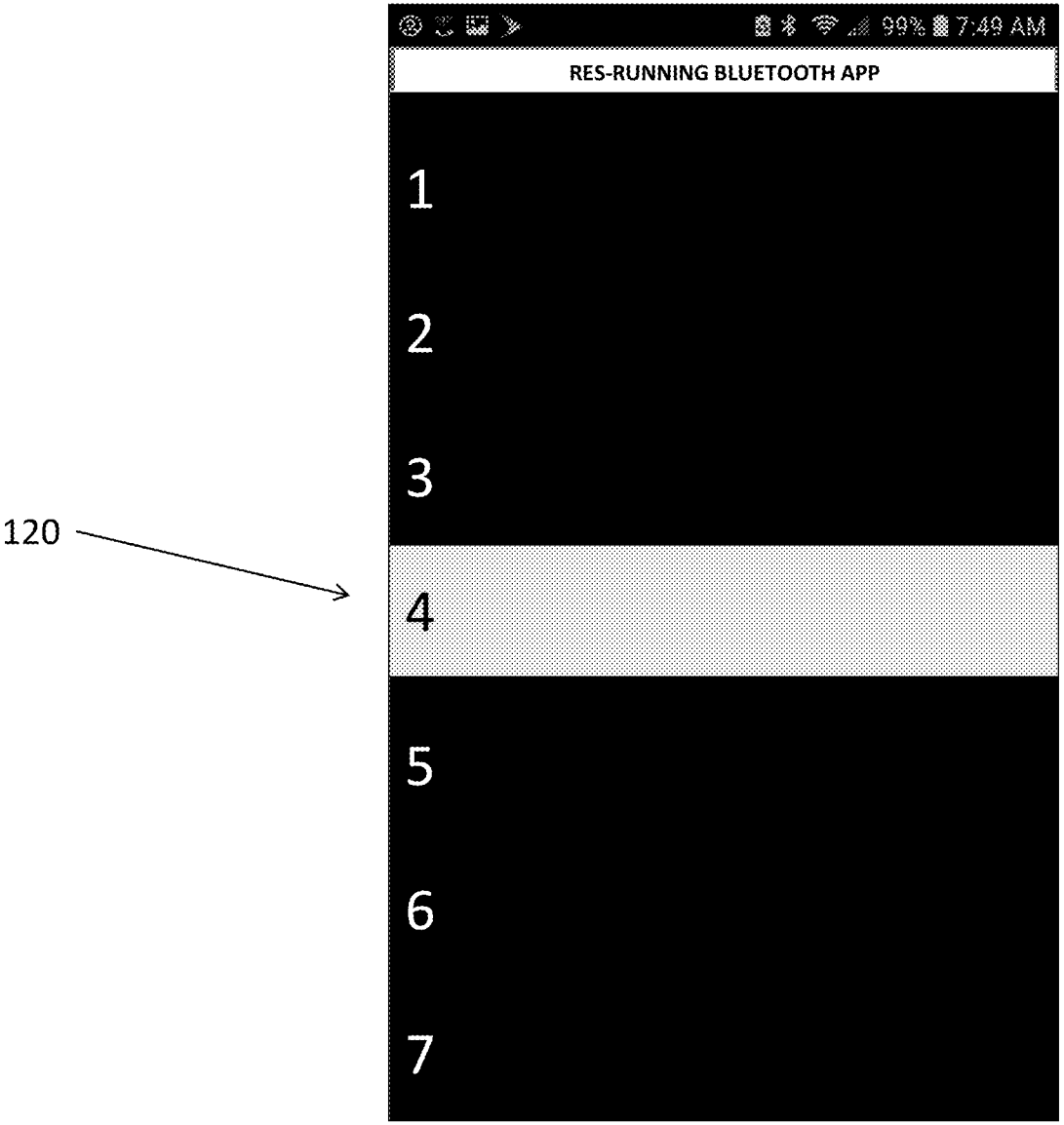
Figure 17:
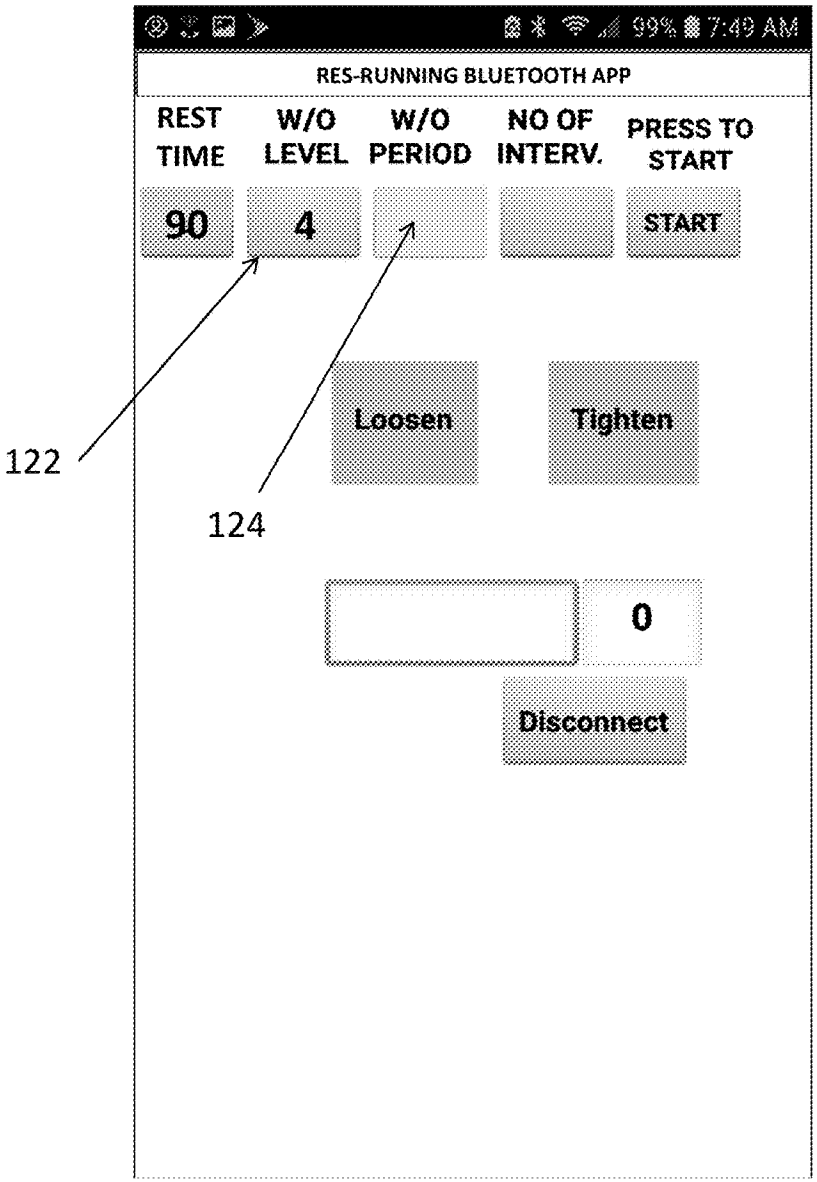
Figure 18:
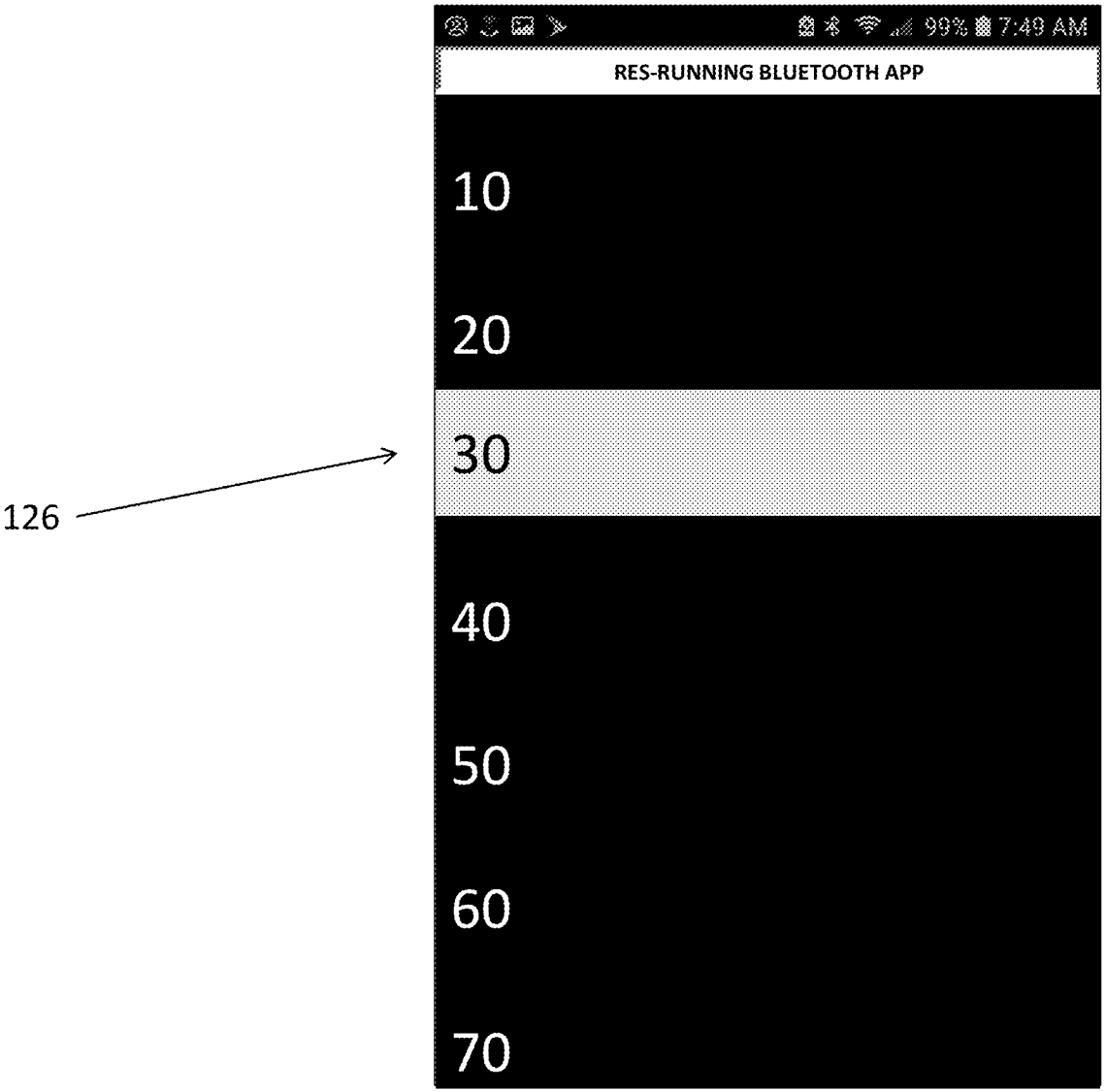
Figure 19:
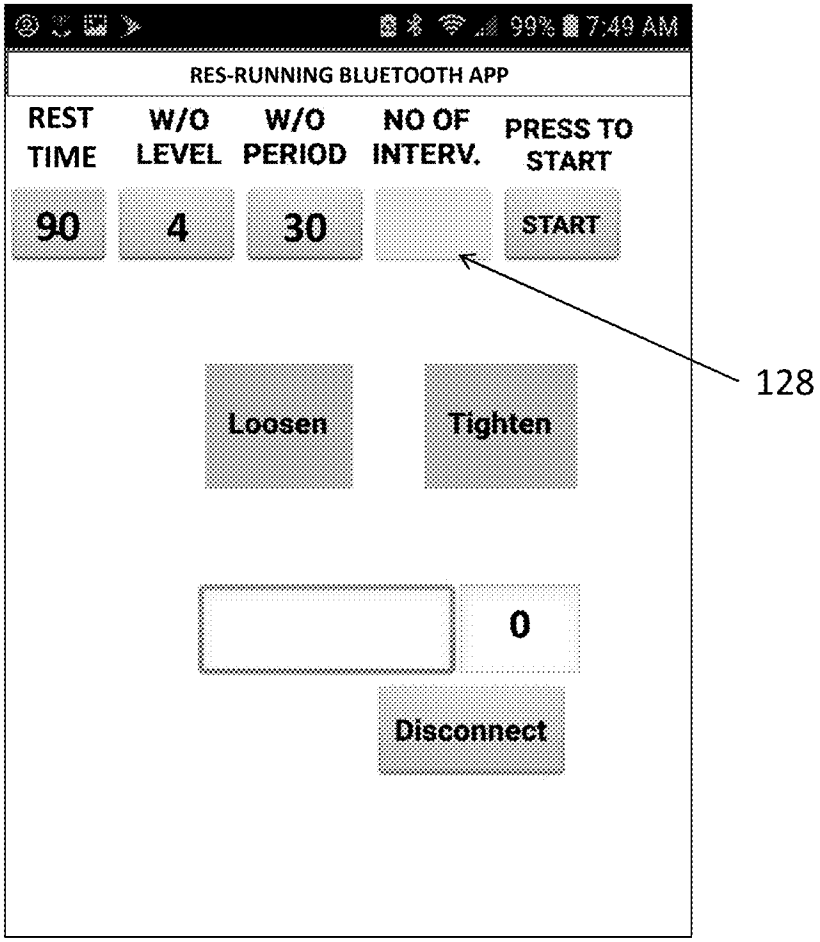
Figure 20:
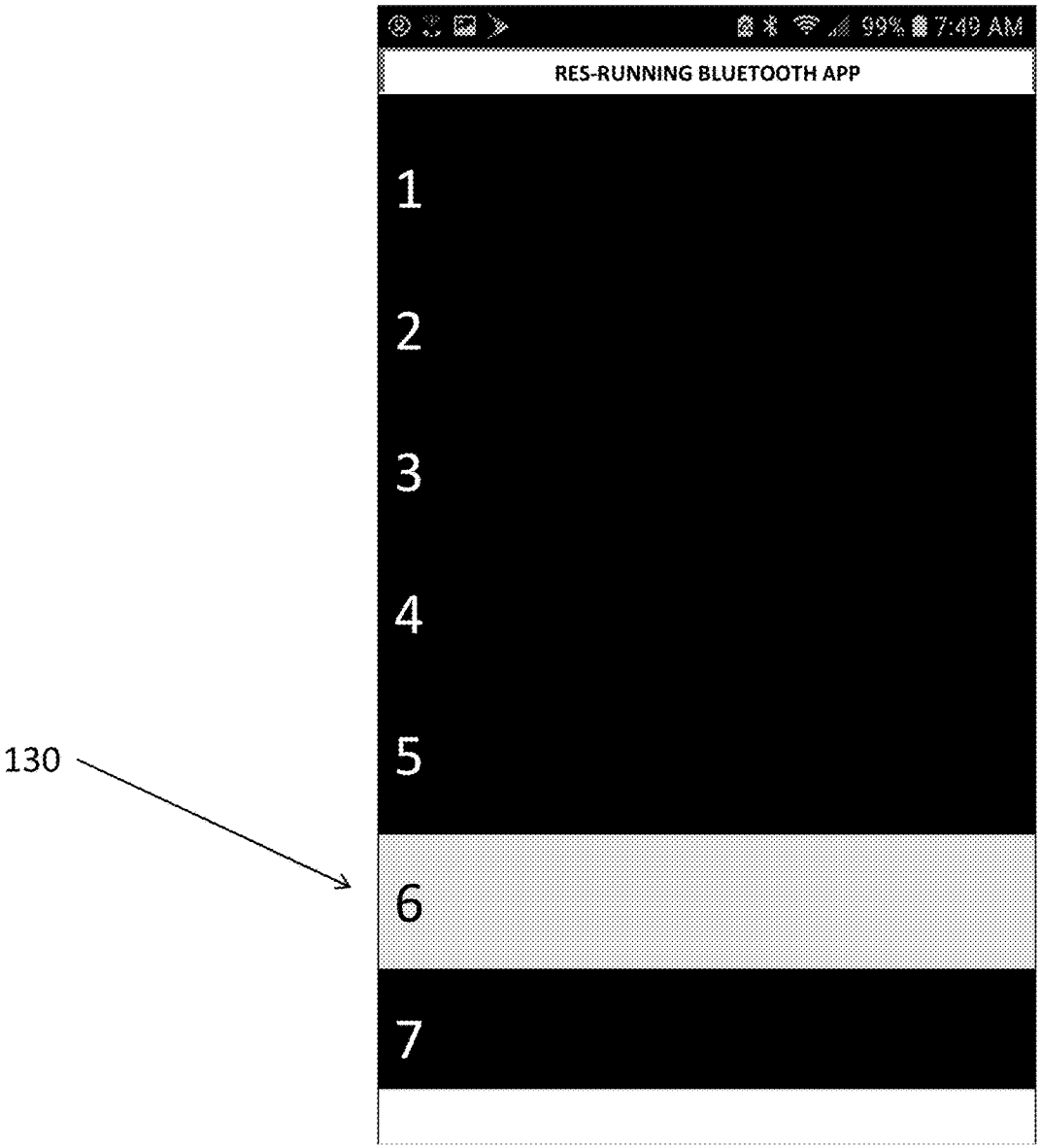
Figure 21:
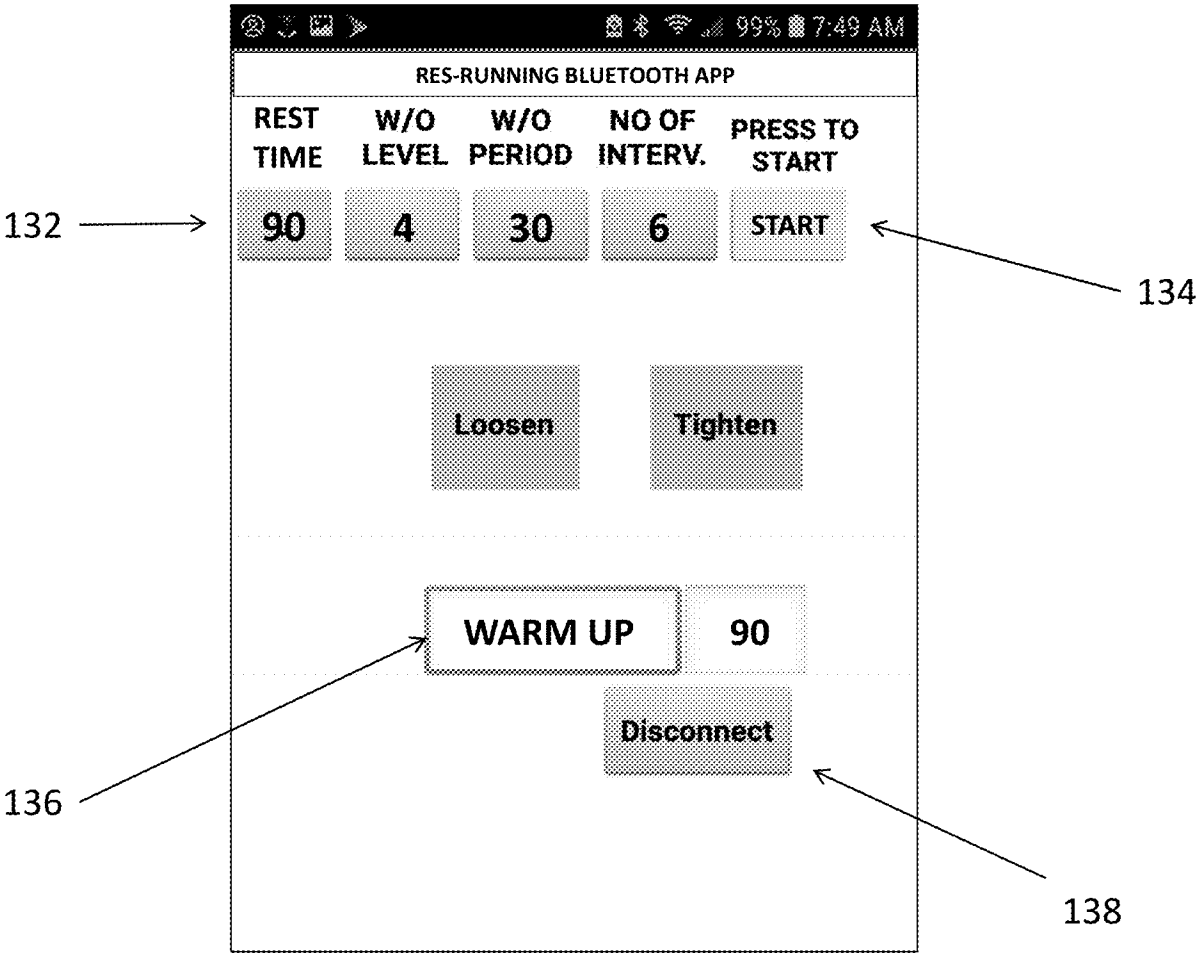

The user then selects a device from a list of previously connected devices, FIG. 11. The application no longer displays a "Connect" input once a device has been successfully connected 108. Before beginning the workout, the user may adjust the band tension for rest and warm-up periods by directing the application to turn the winch securing the band. The user turns the winch to tighten or loosen the band by pressing and holding the respective input 110 moving the winch in the desired direction.

Next a user inputs the workout parameters. The warm-up/rest interval, as set out in seconds is selected in the first box 112. This value sets a warm-up interval at the beginning of the workout and rest intervals alternating throughout the workout. The application displays a list of default times a user can select for the rest interval 114. Alternatively a user may enter a custom time period. The selected time is displayed on the workout screen in the first box 116. Workout level 118 determines the amount of resistance the winch applies to the user by tightening the band during a workout interval.

The application again displays a list of values 120 from which a user selects the desired level. Potential input values from the list represent an algorithmic process where the microprocessor converts the number of revolutions to a relative force value exerted on the user. The relative force value will be within a range of 1-10, or an alternate appropriate range value determined by the system. Again after selection the system displays the designated level in the appropriate field on the next screen 122.

Workout period and Number of Intervals are selected in a similar manner. The Workout Period 124 describes the length of time in seconds when the winch is applying greater force to the user by rotating to a position determined by the previously selected Workout Level. The Number of Intervals 128 determines how many times the system alternates between the workout interval and the rest interval. A user selects the desired field and populates each with an option from lists displayed by the application 126 & 130.

Next, the user confirms the selected values displayed along the top of the screen 132. Once all the parameters for the workout are set the user can start the workout by selecting the start button 134. The workout status monitor 136 activates and maintains the time and current interval of the workout. The status monitor will change between warm-up, workout, and rest depending on the current phase of the workout. After completing a workout, the user can disconnect the application from the device by selecting the disconnect Bluetooth® control input 138.

What is claimed is:

1. An adjustable resistance apparatus comprising:

a universal mounting bracket assembly, wherein the universal mounting bracket assembly secures the adjustable resistance apparatus to a treadmill;

an electric winch;

an upper cross-member, wherein the upper cross-member provides structural support to the adjustable resistance apparatus;

a lower cross-member, wherein the lower cross-member holds the electric winch;

an elastomeric band, wherein the elastomeric band is secured on one end to the electric winch and on an opposite end to a waist attachment point; and a communications system comprising:

a control box, wherein the control box further comprises:

a frame;

a microcontroller comprising a transmitter and receiver;

a 12-volt power supply; and, a winch relay;

wherein the universal mounting bracket assembly further comprises:

a side portion, wherein the side portion further comprises:

a set of winged bolts;

a set of winged bolt slots, wherein the winged bolts slide up and down the winged bolt slots to conform to a treadmill's shape;

a rear portion, wherein the rear portion further comprises an adjustable clamp locking mechanism with winged bolts; and a curved downtube; wherein the downtube further comprises a hollow top into which a vertical pole is inserted.

2. The adjustable resistance apparatus of claim 1 wherein the hollow top of the curved downtube removably mates with the vertical pole by means of a threaded inner surface of the hollow top.

3. The adjustable resistance apparatus of claim 2 wherein the curved downtube further comprises an S-shape with two ninety-degree curves wherein the vertical pole extends upward from behind the rear of a treadmill.

4. The adjustable resistance apparatus of claim 1 wherein the electric winch further comprises a 12-volt DC heavy duty gear motor and a 1.5-inch diameter winch drum.

5. The adjustable resistance apparatus of claim 1 wherein the upper cross-member further comprises:

a first set of exterior pipes;

a first center pipe with smaller diameter than the first set of exterior pipes, wherein the width of the adjustable resistance apparatus may be adjusted by sliding the first set of exterior pipes over the first center pipe; and a first set of compression nuts.

6. The adjustable resistance apparatus of claim 5 wherein the lower cross-member further comprises:

a second set of exterior pipes;

a second center pipe with smaller diameter than the second set of exterior pipes, wherein the width of the adjustable resistance apparatus may be adjusted by sliding the second set of exterior pipes over the second center pipe;

a second set of compression nuts; and a set of winch bolts.

7. The adjustable resistance apparatus of claim 1, wherein the lower cross-member further comprises a set of receiver ends, wherein the receiver ends adjustably slide up and down the vertical pole and lock into a variety of positions by means of a set of cotter pins.

8. The adjustable resistance apparatus of claim 1, wherein the microcontroller further comprises:

a Bluetooth® receiver and transmitter, wherein the user remotely adjusts the resistance of the elastic band through a downloadable application; wherein the microcontroller supplies the appropriate voltage and polarity to the winch relay and the winch relay activates the winch motor.

9. The adjustable resistance apparatus of claim 8, wherein the microcontroller further comprises pre-programmable resistance workouts, wherein the apparatus applies varying resistance throughout a workout without input from the user.

10. The adjustable resistance apparatus of claim 1, wherein the microcontroller further comprises:

a receiver and transmitter, wherein the user remotely adjusts the resistance of the elastic band through a downloadable application; wherein the microcontroller supplies the appropriate voltage and polarity to the winch relay and the winch relay activates the winch motor.

* * * * *